US006918228B2

(12) United States Patent
Yarbrough

(10) Patent No.: US 6,918,228 B2
(45) Date of Patent: Jul. 19, 2005

(54) AUTOMATED BULK BOX STRAPPER

(75) Inventor: Eric Yarbrough, Brentwood, TN (US)

(73) Assignee: International Paper Company, Stamford, CT (US)

( * ) Notice: Subject to any disclaimer, the term of this patent is extended or adjusted under 35 U.S.C. 154(b) by 101 days.

(21) Appl. No.: 10/727,129

(22) Filed: Dec. 3, 2003

(65) Prior Publication Data

US 2004/0107673 A1 Jun. 10, 2004

Related U.S. Application Data

(62) Division of application No. 09/757,172, filed on Jan. 9, 2001, now Pat. No. 6,688,084.

(60) Provisional application No. 60/192,152, filed on Mar. 24, 2000.

(51) Int. Cl.[7] ..... B65B 13/02

(52) U.S. Cl. ..... 53/399; 53/589; 53/590; 100/8; 100/26

(58) Field of Search ..... 53/589, 590, 591, 53/399, 449, 582, 176; 100/2, 7, 8, 32, 29

(56) References Cited

U.S. PATENT DOCUMENTS

| | | | | | |
|---|---|---|---|---|---|
| 3,901,138 | A | * | 8/1975 | Bilt | 100/4 |
| 3,941,639 | A | * | 3/1976 | Maroschak | 156/207 |
| 4,951,562 | A | * | 8/1990 | Ribaldo | 100/8 |
| 5,289,668 | A | * | 3/1994 | Meyer | 53/410 |
| 5,400,706 | A | * | 3/1995 | Tipton et al. | 100/4 |
| 5,761,889 | A | * | 6/1998 | Blaisdell et al. | 53/529 |
| 6,044,620 | A | * | 4/2000 | Hernke et al. | 53/399 |
| 6,074,331 | A | * | 6/2000 | Ruggiere et al. | 493/89 |

* cited by examiner

*Primary Examiner*—Stephen F. Gerrity
*Assistant Examiner*—Thanh Truong
(74) *Attorney, Agent, or Firm*—Daniel C. Stelter

(57) ABSTRACT

A machine and method for applying reinforcing strapping to bulk boxes. The machine includes a plurality of strapping head assemblies arranged in series, with each adapted to apply a strap in encircling relationship to a box at a predetermined location on the box. As the box advances through successive strapping head assemblies, straps are applied in predetermined spaced relationship on the box, until the desired number of straps have been applied. The number, spacing and tension of the straps may be quickly and easily adjusted. In an embodiment of the invention, the strapping head assemblies are arranged in pairs in individual modules. A recovery strapping head assembly is provided just prior to exit from the machine to apply any strapping missed by a preceding strapping head assembly.

4 Claims, 7 Drawing Sheets

AUTOMATED BULK BOX STRAPPER

CROSS-REFERENCE TO RELATED APPLICATIONS

This application is a divisional application of U.S. Ser. No. 09/757,172, filed on Jan. 9, 2001, now U.S. Pat. No. 6,688,084 which claims benefit of U.S. provisional application Ser. No. 60/192,152, filed on Mar. 24, 2000.

BACKGROUND OF THE INVENTION

1. Field of the Invention

This invention relates to the strapping of bulk boxes, and more particularly, to a machine for the automated strapping of bulk boxes.

2. Prior Art

Containers have been developed in the prior art for the bulk storage and shipment of a variety of materials, including meat products, agricultural produce, flowable goods, and other consumer and industrial products. These containers are commonly referred to as bulk bins or bulk boxes, typically varying in size from forty to sixty inches deep and thirty to forty inches wide, and capable of holding and supporting in excess of four thousand pounds of goods.

Bulk boxes are made of various materials, but commonly employ corrugated cardboard in their construction. Liners are sometimes used to improve the strength of the boxes and to insure leakproof containment of the goods held therein.

The internal contents of these boxes, often fluid, provide minimal support of their own weight and rely upon the structural integrity of the container to support the full weight of the contents. Bulk boxes, unlike most corrugated containers, must resist strong forces in both horizontal and vertical directions. These conditions can cause the sidewalls to bulge outwardly and possibly fail. To alleviate this problem, one or more, typically four to eight, external reinforcing bands or straps of plastic or metal are sometimes applied to the boxes.

In the prior art, the reinforcing straps are manually applied to the boxes, generally with the boxes in a knocked-down or flattened state. This process is time-consuming and expensive, with the ratio of the cost of labor to the cost of materials often as much as 4:1.

Machines are known in the prior art for applying strapping around objects, including boxes, for bundling them together. The heaviest, or largest, strapping that can be handled with these machines is four hundred pounds. Reinforcing strapping as used in the present invention is typically six hundred pound strapping. Applicant is not aware of any prior art machine that applies reinforcing strapping to a container, or any bundling strapper that is capable of handling strapping larger than four hundred pounds.

Accordingly, there is need for an economical system and method for applying external reinforcing straps to bulk boxes.

SUMMARY OF THE INVENTION

In accordance with the invention, an automated system and method are provided for economically applying reinforcing straps to bulk containers.

With other costs remaining constant, the system and method of the invention enables external reinforcing straps to be applied to bulk boxes at a ratio of the cost of labor to the cost of materials of about 1:3, or a 12:1 improvement over the prior art.

The invention comprises an automatic strapping machine that applies one or more straps externally to a bulk box to reinforce the box. More specifically, the strapping machine of the invention applies a plurality of reinforcing straps around the outside of the box in spaced apart relationship along the length or height of the box, while the box is in its knocked-down or flattened condition. The straps can be uniformly spaced apart, or the straps nearer the bottom of the box can be spaced more closely together than the straps toward the top of the box, depending upon the requirements of a particular application. From four to eight straps are generally applied to a box, although this number can vary as desired or required.

The strapping machine of the invention has a plurality of strapping stations or stages through which the box, in a knocked-down or flattened state, passes for sequential application of the straps to different locations on the box. The straps are applied by strapping head assemblies positioned at the strapping stations, each of which receives a length of strapping material from a supply reel, encircles the box with a strap, secures the strap in encircling relationship to the box, and cuts the strap encircling the box from the length of supply strapping in preparation for continued movement of the box to the next station. Suitable sensing means, such as photocells or microswitches and the like, are positioned at each station to sense the position of the box and stop it in a predetermined location for application of the straps.

Each station may be constructed as a separate module having two strapping head assemblies. A single disconnectable data and power connection is provided. Each module will be large enough to hold an entire bulk box in process. All of the modules can be identical and interchangeable with one another, but the last module in a series preferably comprises a recovery module to apply any straps that were missed in an earlier station.

Further, the modules can operate independently of one another. That is, inoperability of one module, or one or more strapping heads at a module, will not affect the operation of another, except that a recovery module can apply any missing straps. This enables one or more strapping heads or modules to be taken out of service and the machine can still operate. Straps that would have been applied by the inoperable strapping head are applied by the recovery module, which can apply all of the straps if all of the preceding heads are inoperable.

In a preferred embodiment, two strapping head assemblies are provided at each station, with each head assembly arranged to position a strap at a predetermined location on the box. The head assemblies at subsequent stations are positioned to apply further straps at different predetermined locations on the box. A last station that normally is not utilized may be provided to apply a strap or straps that were inadvertently not applied at a preceding station.

An infeed can be provided to supply boxes to the machine to be strapped, or boxes can be hand fed to the machine. A stacker preferably is positioned to receive strapped boxes from the machine. As a box is called into the machine, any boxes in the system all shift one module toward the outlet. After module 1 has called for a box and all boxes have shifted downstream into place, all strapping head assemblies will activate. For a four station machine, with the fourth station serving as a recovery module, there will be six boxes in process at any given time. Each module will have a box ready for strapping, one box will be in the infeed ready for the next start cycle, and one box will be in the stacker. Each module, except the fourth in this example, will apply two straps on the box. The recovery (fourth) module will apply any missing straps. The cycle time for each strapping station is about 6.4 seconds, and approximately 545 boxes per hour can be strapped.

The placement of positioning of the straps, and initiation of operation of the strapping heads at each module, are controlled by sensors that detect the position of each box at a station and operate to cause a limit stop to move into the path of the box to halt its movement through the station at a predetermined position for placement of the straps applied at that station in specific locations on the box. After the straps have been applied, the limit stop is moved out of the way of the box and it is moved to the next station where another sensor and limit stop operate to position the box for placement of an further pair of straps at predetermined different locations on the box. This process is repeated at each station until all straps have been applied.

Control means senses when a strap or straps have been missed, and operates to cause the box to be stopped at one or more positions in the recovery station for application of the missing strap or straps.

In a specific example of the machine, the strapping heads in the strapping head assemblies are based on the EAM Mosca KSR bundle strapper, which is capable of threading, cutting and welding a six hundred pound strap. These heads have been modified in the present invention to increase the throat size to accommodate an eighty-four inch throat.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein.

DETAILED DESCRIPTION OF THE PREFERRED EMBODIMENTS

Figure 1:
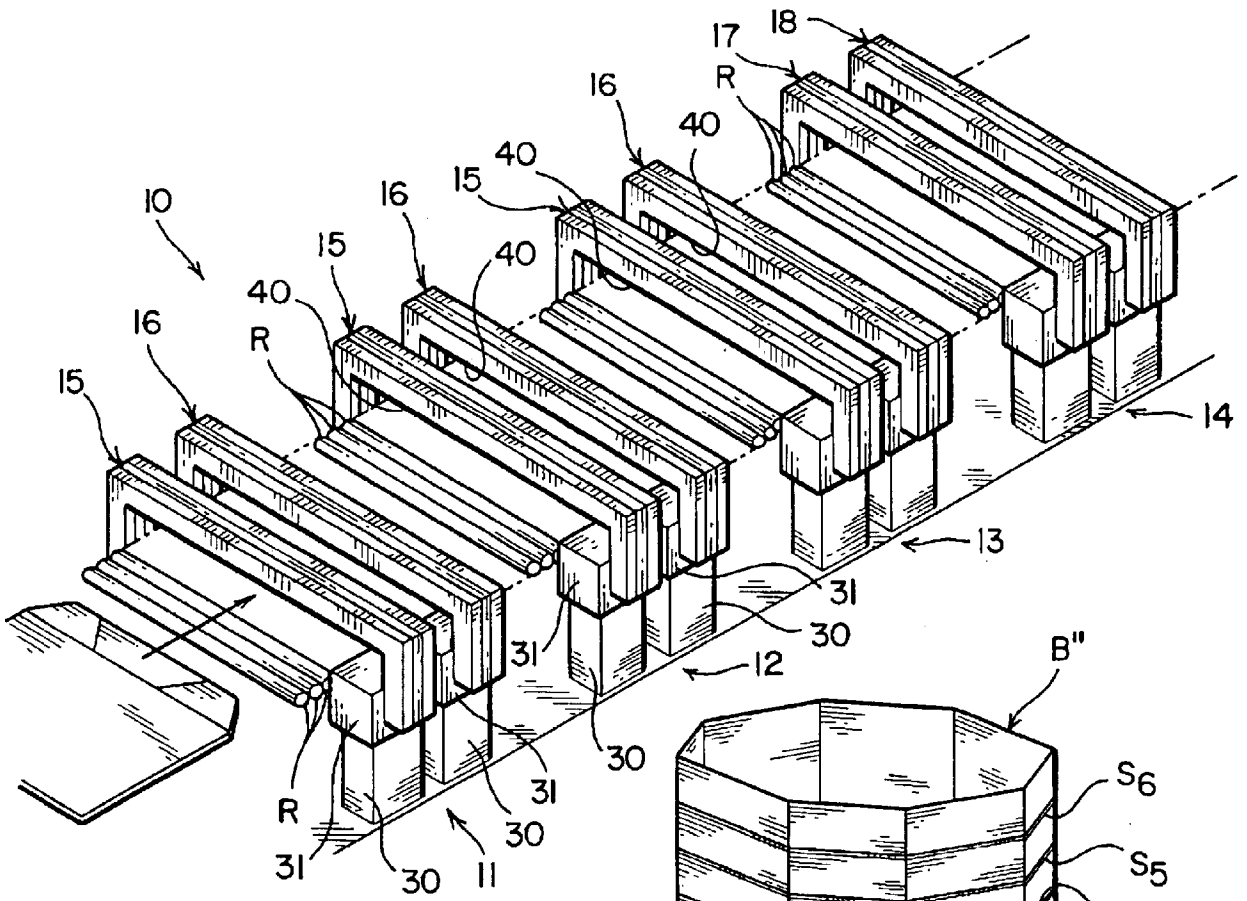
FIG. 1 is top perspective view of a bulk box strapping machine according to the invention.

Referring more specifically to the drawings, a bulk box strapping machine according to the invention is indicated generally at 10 in FIGS. 1, 4A–4B and 5A–5B. In the embodiment illustrated and described herein, the machine is shown as having four strapping stations 11, 12, 13 and 14, with stations 11, 12 and 13 each having two strapping head assemblies 15 and 16, whereby the machine is adapted to apply six straps to a box. Strapping station 14 comprises a recovery station, and as shown herein has two strapping head assemblies 17 and 18 that can apply any strap or straps not applied at a preceding station due to a malfunctioning head assembly or absence of strapping material, etc. The recovery strapping station 14, or any of the other strapping stations, could include only one strapping head assembly, if desired.

Further, as illustrated and described herein the strapping stations are modular, whereby the stations may be increased or decreased in number, individually adjusted, replaced, disabled or enabled without disturbing the other stations. It should be understood, however, that the strapping stations need not be modular, but a desired number of individual strapping head assemblies may be appropriately spaced from one another in the machine, depending upon the number of straps desired on the bulk box, with or without resorting to modular design.

Folded-flat bulk boxes B are supplied to the machine via a suitable infeed system 20, although the boxes could be hand fed to the machine, if desired. The infeed system 20 includes an elevator means 21 for supporting a stack S of folded flat boxes B and for continuously moving the stack upwardly to position another box to be fed to the machine, and a reciprocating arm 22 connected with a source of vacuum (not shown) for picking up the top box in the stack and positioning it to be grabbed between a pinch roll 23 and drive roll or belt 24.

After being fed into the machine, the boxes are continuously carried forward by suitable drive means such as, for example, the endless belts 24, as shown in FIGS. 4A–4B, 5A–5B, 6 and 7, extending between the modules, or by rollers R as shown in FIG. 1.

Suitable sensors (not shown), such as photocells, microswitches, or the like, are positioned at each strapping station to detect the presence and position of a box at that station and cause a limit stop 28 to be moved into the path of the box to halt its movement at a predetermined position for applying straps at that station in specific locations on the box. The limit stop may comprise, for example, a pneumatic, hydraulic or electric drive 29 which moves a plunger into the path of the box in response to a signal from the sensor. The stops are located at predetermined distances downstream of their respective stations for stopping the boxes in a different position at each station to apply straps at different locations on the box than the straps applied at a preceding or succeeding station.

The boxes may be fed into the machine with either their top end or bottom end leading, but if the spacing of the straps is to be varied between the top and bottom ends of the box, appropriate adjustment will need to be made of the stop means and sensor means for each module.

For instance, at the first strapping station 11, a pair of straps $S_3$ and $S_6$ are applied to the box at predetermined locations (see FIG. 2) in spaced apart relationship to one another (in the example shown the box is supplied bottom-end-first into the machine). The box is then advanced to the second strapping station 12, where a second set of straps $S_2$ and $S_5$ are applied to the box at further predetermined locations, in spaced apart relationship to one another and to the first set of straps. Similarly, a third set of straps $S_1$ and $S_4$ are applied to the box at the third strapping station 13. As noted previously, six boxes are in process in the machine at any given time, one in the infeed 20, one at each station, and one in the discharge or outfeed stacker assembly SA. The boxes at the various stations all stop at approximately the same time, but at a further advanced position in the succeeding stations, where the straps are applied, and the boxes again advanced in unison to the next station.

Figure 2:
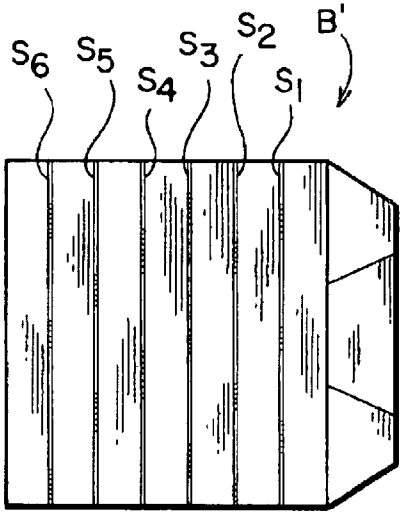
FIG. 2 is a top plan view of a folded-flat bulk box that has been strapped with the machine of FIG. 1.

A folded-flat strapped box B' is shown in FIG. 2. Obviously, a greater or lesser number of straps can be applied by increasing or decreasing the number of stations or strapping head assemblies, or by inactivating one or more of the strapping stations or strapping head assemblies.

Figure 3:
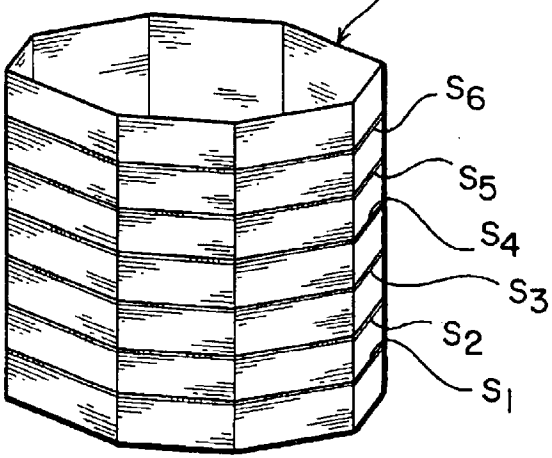
FIG. 3 is a perspective view of the bulk box in erected position.
Figure 4A:
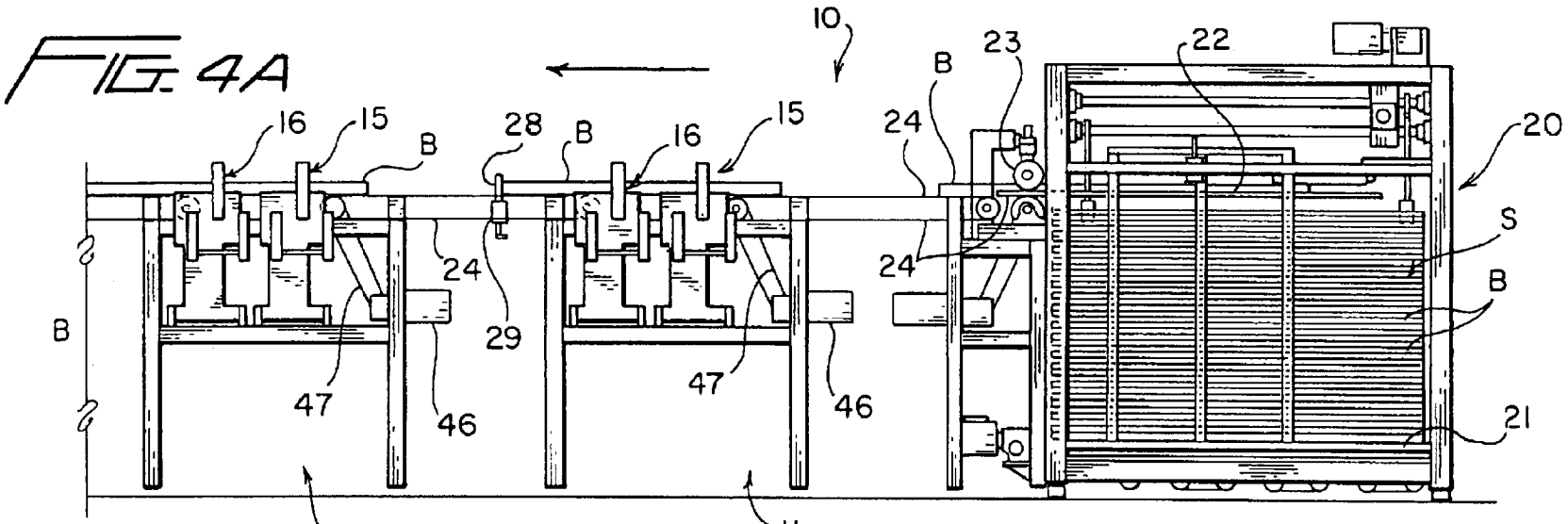
FIGS. 4A and 4B are side elevational views of a strapping machine according to the invention, wherein FIG. 4A joins to FIG. 4B at the break A–B.
Figure 4B:
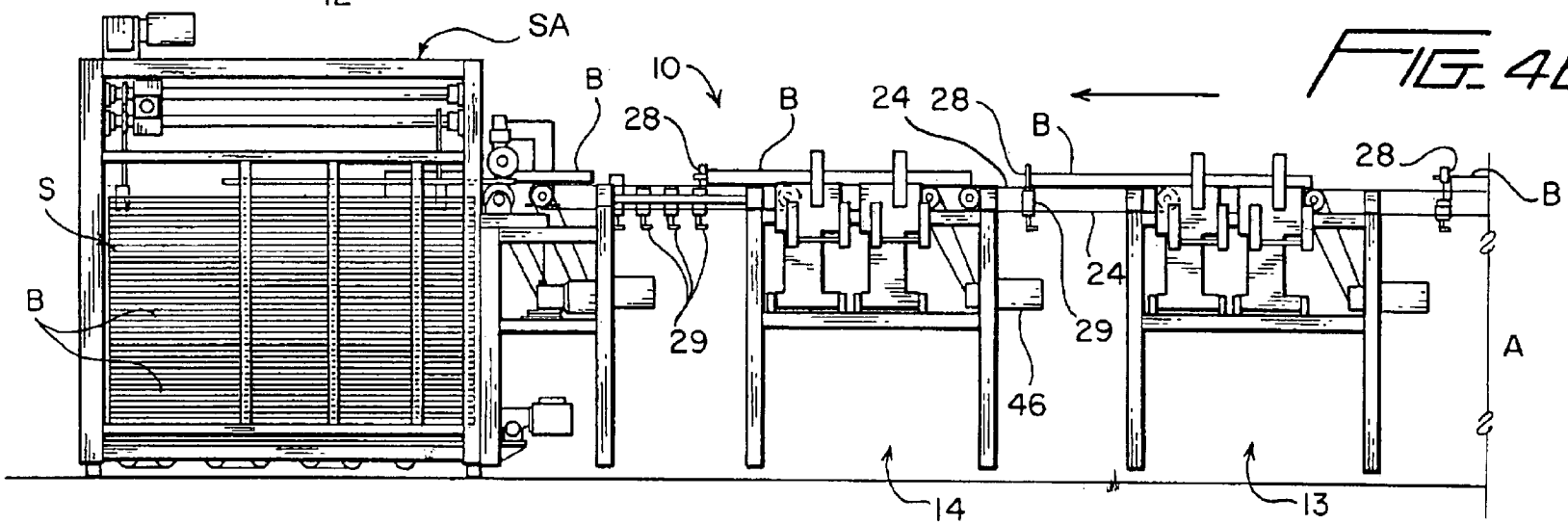
Figure 5A:
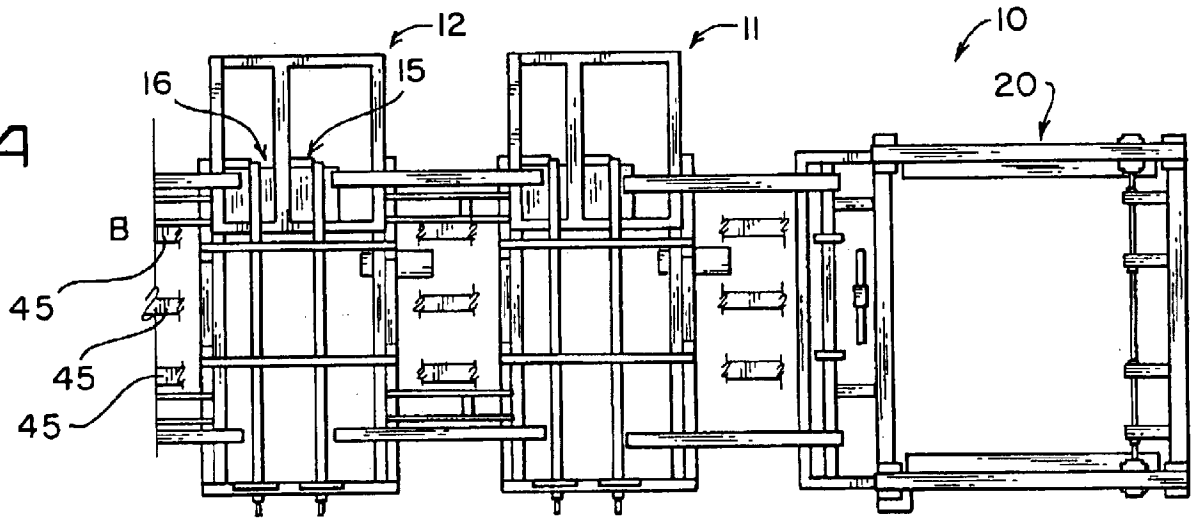
FIGS. 5A and 5B are top plan views of the machine of FIGS. 4A and 4B, wherein FIG. 5A joins to FIG. 5B at the break A–B.
Figure 5B:
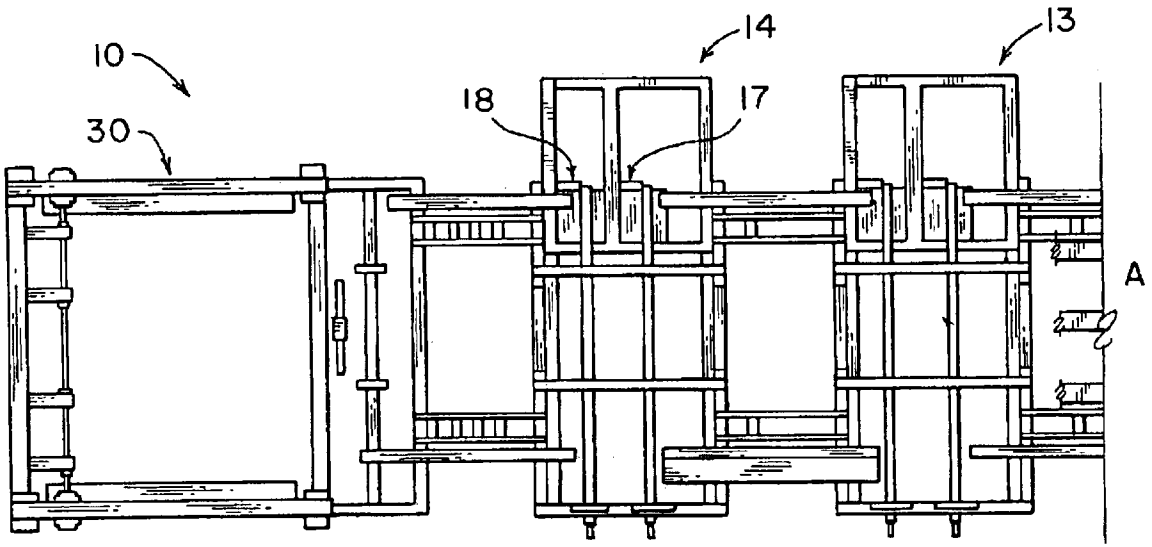
Figure 6:
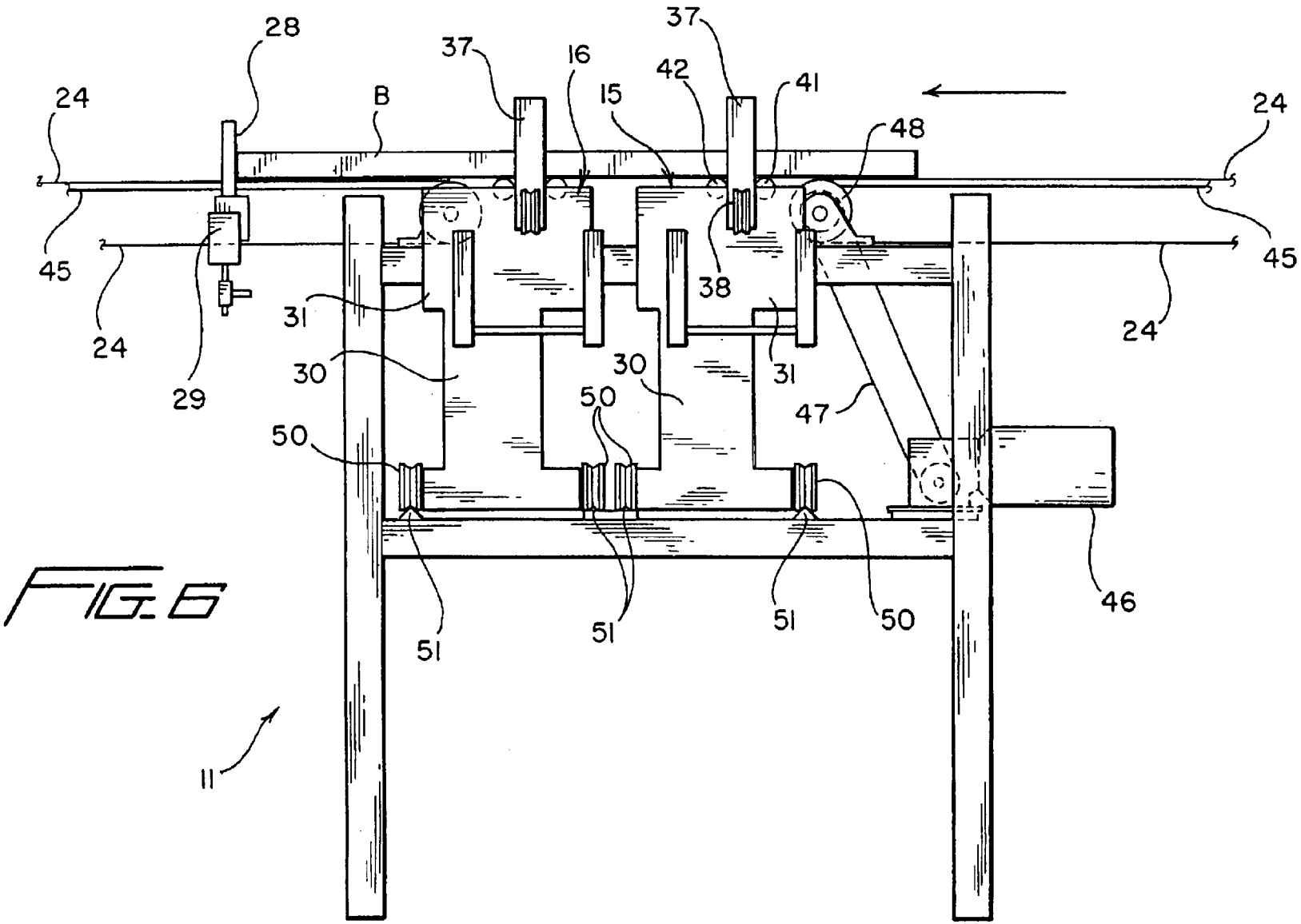
FIG. 6 is an enlarged end view in elevation of one of the strapping modules used in the machine of the invention.
Figure 7:
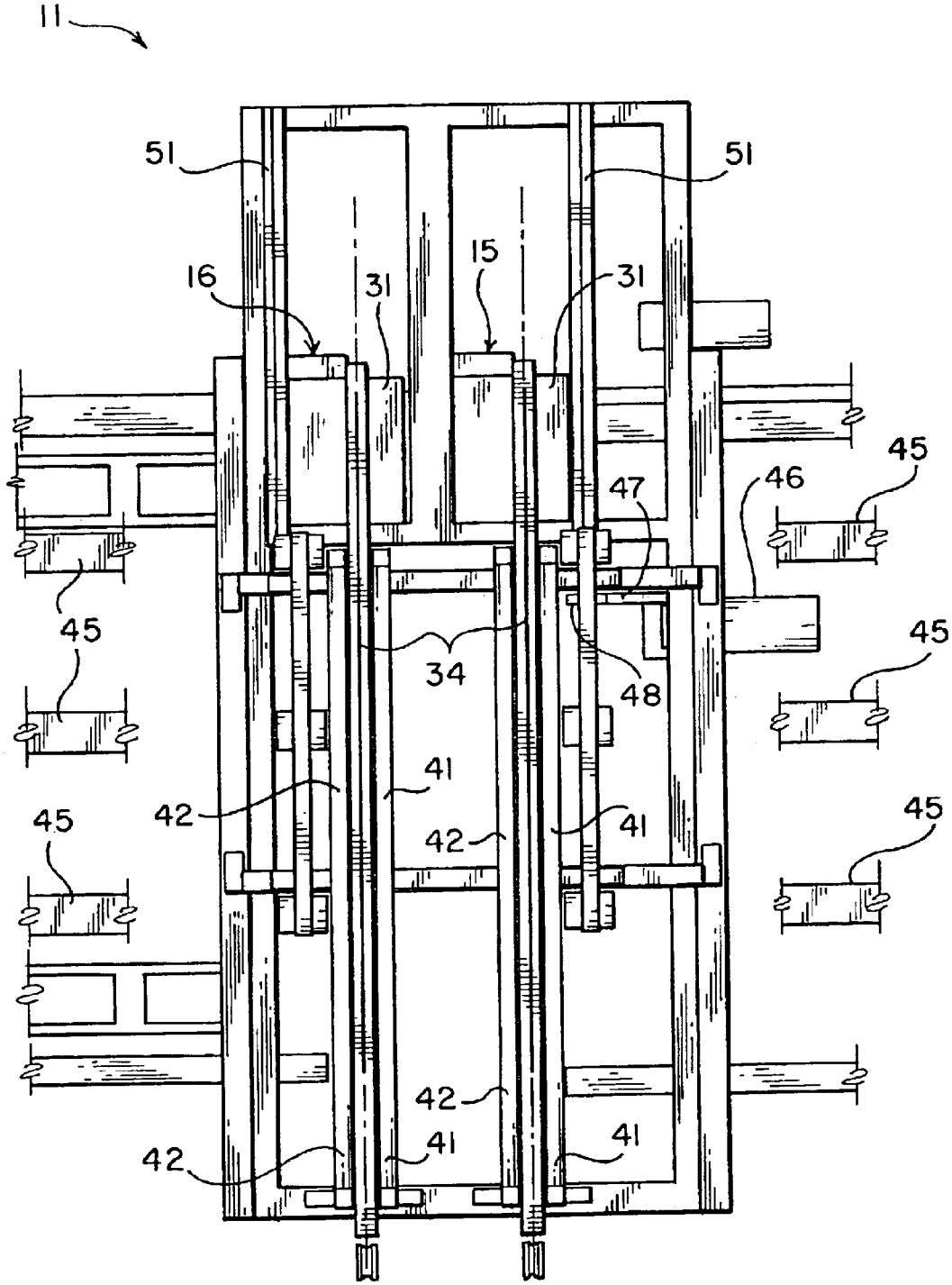
FIG. 7 is a top plan view of the strapping module of FIG. 6.

The strapped boxes, in their folded-flat condition, may then be shipped to a customer, where the boxes may be quickly and easily erected, as shown at B" in FIG. 3, with the straps applied.

Figure 8:
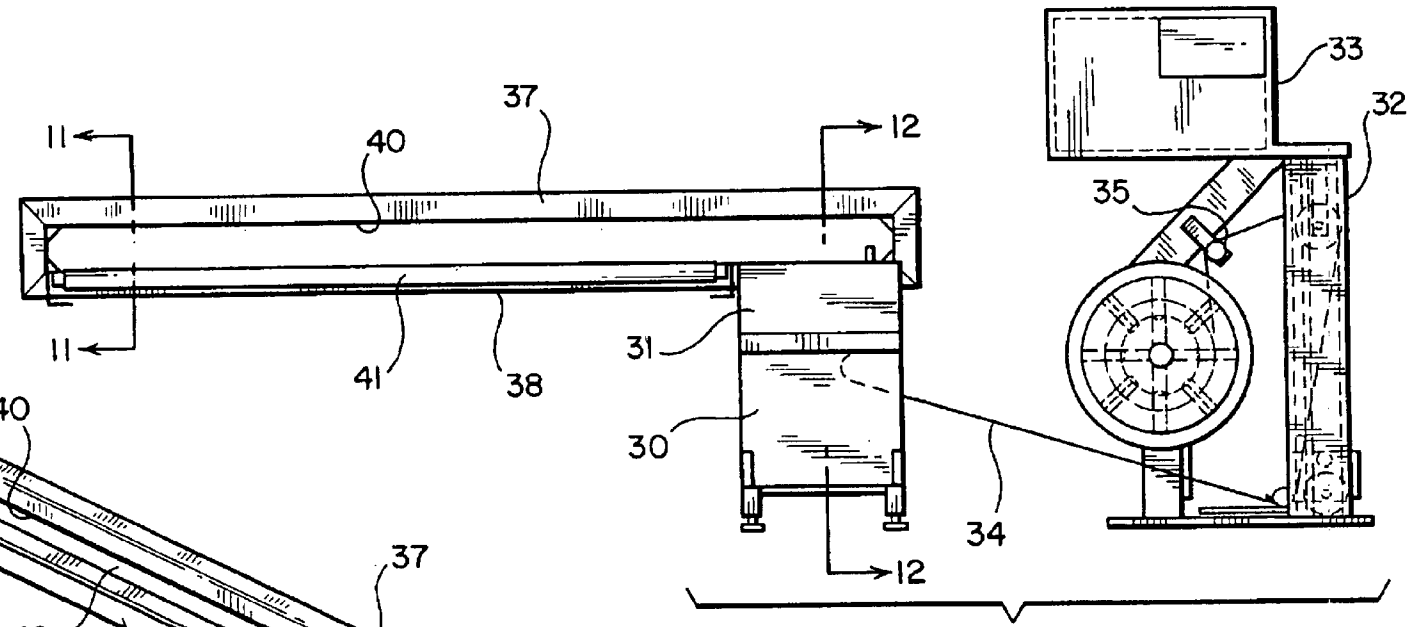
FIG. 8 is a side view in elevation of one of the strapping head assemblies as used in the machine of the invention, showing a control panel and strap supply reel.

The strapping head assemblies are identical to one another, and each includes an accumulator section 30 which forms a base to support the strapping head 31 and also provides a receptacle to store pieces of strapping material cut off when a strap is secured around a box. A supply reel 32 and control panel 33 are supported near the strapping head assembly for supplying strapping to the strapping head assembly and controlling operation of the machine, respectively. As shown in FIG. 8 in dashed lines 34, the strapping is fed from the reel over an idler wheel 35 and sprocket 36 and into the strapping head 31 of the strapping head assembly. The strapping is then fed by the strapping head through top and bottom tracks 37 and 38, to form a loop of the strapping around the box positioned at that strapping head assembly. The free or lead end of the strapping is then gripped by the strapping head, secured to the length of strapping, and cut off, to form a loop of the strapping material closely encircling the box.

Figure 9:
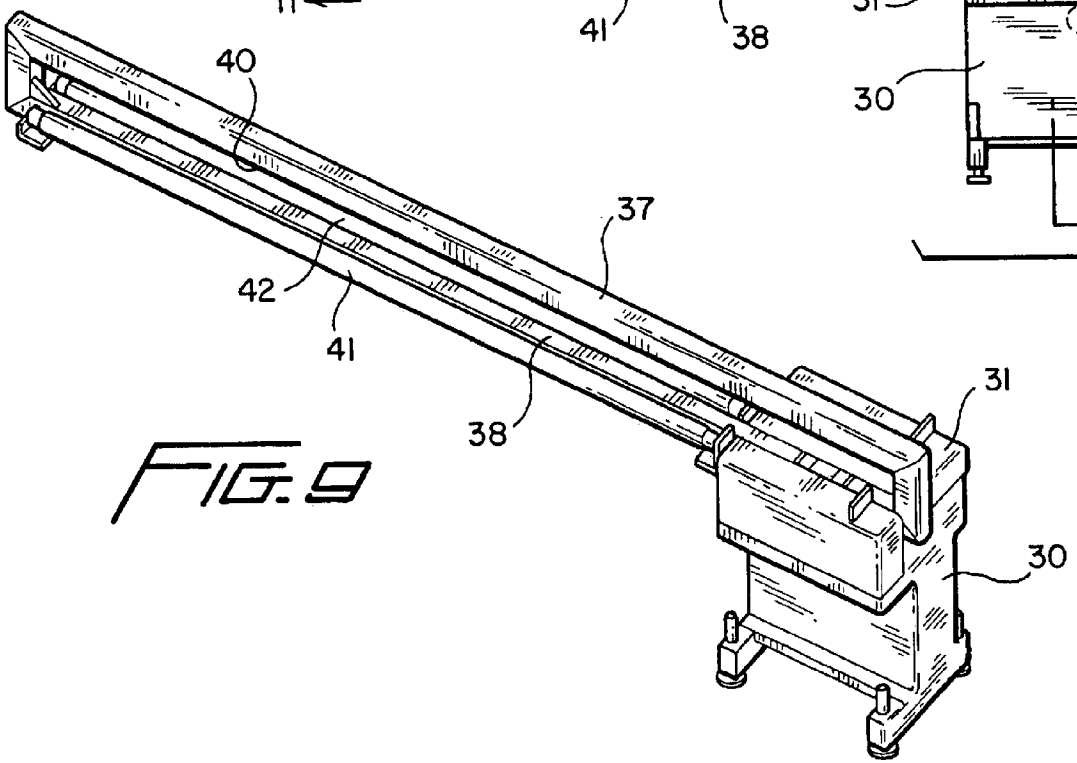
FIG. 9 is a top perspective view of one of the strapping head assemblies of the machine.
Figure 10:
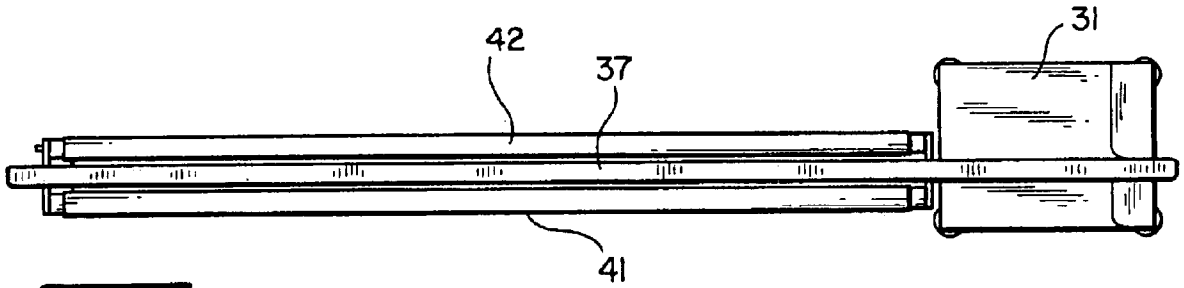
FIG. 10 is a top plan view of one of the strapping head assemblies.
Figure 11:
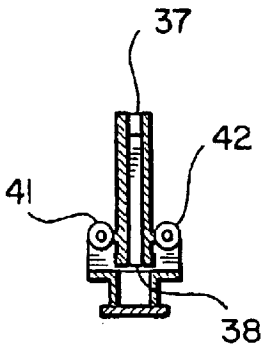
FIG. 11 is a transverse sectional view taken along line 11—11 in FIG. 8.
Figure 12:
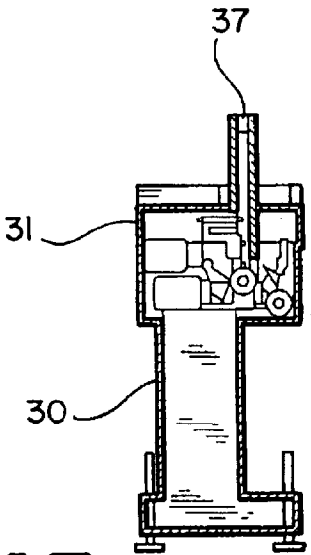
FIG. 12 is a transverse sectional view taken along line 12—12 in FIG. 8.

It will be noted from FIGS. 1, 8 and 9 that the tracks of the strapping head assembly form a relatively wide, narrow opening 40 through which the box passes as it moves through the machine. In the particular construction illustrated and described herein, a pair of rollers 41 and 42 are positioned on opposite sides of the bottom track 38 to support the box. Other support and/or drive means for the box could be utilized, as desired and appropriate.

The supply reels 32 are secured by a single fastener so that they may be quickly removed and replaced with fresh reels as the strapping becomes exhausted on the first reel. The free end of the strapping is then grasped by the operator and inserted into the strapping head, which grips the strapping and automatically threads it through the tracks and back to the head.

As depicted in FIGS. 1, 4A–4B and 5A–5B, the strapping head assemblies are arranged for applying six straps to a box, as shown in FIG. 2. In this arrangement, the strapping head assemblies 15 and 16 in each module are spaced eighteen inches apart, and place the straps at uniformly spaced intervals of six inches. If eight reinforcing straps are to be applied, the strapping head assemblies are spaced twenty four inches apart, with straps $S_1$ and $S_5$ being applied together at one station; straps $S_2$ and $S_6$ applied at another station; straps $S_3$ and $S_7$ applied at a still further station; and straps $S_4$ and $S_8$ applied at yet another station.

It will be noted that the boxes are supplied to the machine in spaced apart relationship. This relationship is maintained throughout the sequence of steps in applying the desired number of straps by appropriate location and operation of the sensors, limit stops and feed means.

The control system detects whether any given strapping head assembly has or has not correctly applied a reinforcing strap to the box, and if a strap has been missed sends an appropriate command to the machine to stop the box at an appropriate position at the recovery station 14 so that the strapping head assemblies 17 and 18 at the recovery station can apply the missing strap or straps.

As seen best in FIGS. 4A–4B, 5A–5B, 6 and 7, at least the upper flights of the belts 24 are supported on plates 45 extending between the modules. Motors 46 are connected through drive chains or belts 47, or other suitable drive connection, with sprockets 48 to drive the belts carrying a box to each strapping station.

To facilitate maintenance, adjustment, replacement, etc., of the strapping head assemblies 15, 16, 17 and 18, the head assemblies are mounted via rollers 50 on tracks 51 so that the heads may be moved laterally at least partially out of the machine.

The strapping head assembly and the machine of the invention enable boxes to be strapped much more quickly and economically than is possible with prior art systems and methods. Moreover, the machine may be quickly and easily adjusted to apply a greater or a lesser number of straps, and to position the straps with different spacing on the boxes.

While particular embodiments of the invention have been illustrated and described in detail herein, it should be understood that various changes and modifications may be made to the invention without departing from the spirit and intent of the invention as defined by the scope of the appended claims.

What is claimed is:

1. A method of applying a plurality of parallel reinforcing straps in predetermined spaced locations on a bulk box while the box is in a knocked-down or flattened condition, comprising the steps of:

providing a machine having a plurality of spaced apart strapping head assemblies each operable to apply a reinforcing strap to the flattened box at a predetermined different location on the box;

moving a box through the machine and past the strapping head assemblies;

stopping the flattened box at each strapping head assembly to apply a strap to the flattened box in a position different from the position of a strap applied at a preceding strapping head assembly, but parallel thereto, and then advancing the box to a next strapping head assembly for application of a further strap, until the desired number of straps have been applied;

operating each strapping head assembly while the flattened box is stopped to loop a strap around the flattened box, apply tension to the strapping, secure the strapping to itself to form a loop of strapping closely encircling the flattened box, and cut the loop from the supply, whereby a box erected from the flattened box has a plurality of spaced apart, parallel reinforcing straps pre-applied thereto.

2. A method as claimed in claim 1, including the steps of:

simultaneously moving a plurality of boxes through the machine;

stopping all of the boxes at the same time, with each box positioned at a strapping head assembly; and simultaneously operating all strapping head assemblies to simultaneously apply straps to all of the boxes, with each strap being applied in a different position and parallel to the other straps.

3. A method as claimed in claim 2, including the steps of:

providing a plurality of pairs of strapping head assemblies arranged in series in the machine; and simultaneously applying a pair of straps to each box as the boxes are stopped.

4. A method as claimed in claim 3, wherein:

each pair of strapping head assemblies applies a pair of straps in spaced, interspersed relationship with other straps, whereby at least one strap of a previously applied pair of straps is located between the straps of a later applied pair of straps.

* * * * *